United States Patent [19]

Messing

[11] Patent Number: 4,885,233

[45] Date of Patent: Dec. 5, 1989

[54] MERCURY AND BENZOTHIAZOLIUM SALT STABILIZATION OF A PHOTOGRAPHIC RECORDING MATERIAL

[75] Inventor: Calvin R. Messing, Spencerport, N.Y.

[73] Assignee: Eastman Kodak Company, Rochester, N.Y.

[21] Appl. No.: 225,497

[22] Filed: Jul. 28, 1988

[51] Int. Cl.[4] ..... G03C 1/34

[52] U.S. Cl. ..... 430/608; 430/611; 430/614

[58] Field of Search ..... 430/608, 611, 614

[56] References Cited

U.S. PATENT DOCUMENTS

| | | | |
|---|---|---|---|
| 2,694,716 | 11/1954 | Allen et al. . | |
| 2,728,663 | 12/1955 | Allen et al. | 430/599 |
| 2,728,664 | 12/1955 | Carroll et al. . | |
| 3,615,620 | 10/1971 | Willems et al. . | |
| 4,596,767 | 6/1986 | Mihara et al. | 430/576 |

FOREIGN PATENT DOCUMENTS

| | | |
|---|---|---|
| 64357 | 1/1982 | Japan . |

*Primary Examiner*—Paul R. Michl
*Assistant Examiner*—Janet C. Baxter
*Attorney, Agent, or Firm*—Thomas F. Kirchoff

[57] ABSTRACT

Photographic recording material is described which employs a combination of a mercury compound and a benzothiazolium compound to reduce chemical fog without adverse loss of photographic speed.

13 Claims, No Drawings

MERCURY AND BENZOTHIAZOLIUM SALT STABILIZATION OF A PHOTOGRAPHIC RECORDING MATERIAL

The present invention relates to a photographic recording material and to stabilization thereof with respect to minimizing or to eliminating fog formation during storage.

Spontaneous formation and growth of fog in photographic recording materials during storage, particularly during prolonged storage or storage under conditions of elevated temperature and humidity, is a well recognized problem in the photographic art. Such fog is known as chemical fog and is to be distinguished from fog which is caused by exposure of photographic material as occurs, for example, from inadvertent light leaks.

Various suggestions have been made to reduce or to eliminate chemical fog formation. These suggestions include the use of mercury compounds. For example, U.S. Pat. No. 2,728,664 describes the use of both mercurous and mercuric salts, such as their respective halides, sulfates and nitrates, as well as their organic acid salts, such as acetates, to retard or to eliminate fog formation.

Experience with mercury salts as fog retardants has not been completely satisfactory. While such salts generally demonstrate adequate antifoggant and stabilization action, it has also been observed that mercury salts adversely reduce the photographic speed of silver halide emulsions containing such salts.

Reducing the amount of mercury salt has the effect of lowering speed loss but also results in lowered antifogging or stabilizing action.

Attempts to substitute oxides of mercury in place of salts thereof, as suggested in U.S. Pat. No. 3,615,620, have also been relatively unsuccessful in that while fog formation is suppressed, the concomitant loss of photosensitive activity is still observed. This loss of photographic speed has prevented wide commercial acceptance of the use of mercury compounds.

Suggestions have been made to use organic compounds, or salts thereof, as antifoggants or stabilizers. For example, U.S. Pat. No. 2,694,716 describes polymethylene-bis-benzothiazolium salts which are stated to be useful antifogging agents in photographic silver halide emulsions. While such benzothiazolium compounds do exhibit antifogging properties, their use is not as effective in this respect as are mercury compounds such as are noted above.

Combination of a disulfide compound with a small amount of a mercury compound is shown in Japanese Patent Publication No. 643-57, of Jan. 5, 1982, to be effective in reducing thermal fog in light sensitive thermographic materials. However, this same Publication also shows that a benzothiazole compound is less effective in fog inhibition and that such compound adversely affects the relative sensitivity of a thermographic element as compared with use a disulfide compound.

Notwithstanding the foregoing publications, the problem still remains of preventing, or effectively reducing, raw stock fog formation in photosensitive silver halide recording materials without adversely affecting other desirable photographic properties.

The present invention overcomes this problem by providing a photographic recording material comprising a support having thereon a radiation sensitive silver halide emulsion layer and an effective amount of a fog inhibiting combination of (a) a compound which is an oxide or a salt of mercury, and (b) a benzothiazolium compound having the structural formula:

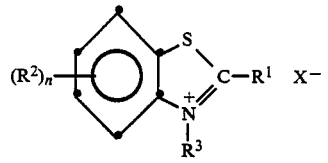

wherein:

$R^1$ is hydrogen or an alkyl group having from 1 to about 4 carbon atoms;

$R^2$ is an electron withdrawing group;

$R^3$ is hydrogen, an alkyl group having from 1 to about 4 carbon atoms or benzyl;

X is an anion; and n is 0 or from 1 to 3.

The alkyl groups which can be represented by $R^1$ and $R^3$ in the above formula include straight and branched chain groups. These groups can also be substituted with, for example, halogen atoms, hydroxy or mercapto groups and alkoxy groups where alkoxy can comprise from 1 to about 4 carbon atoms. Chlorine is a preferred halogen substituent.

The electron withdrawing group which can be represented by $R^2$ is halogen, e.g. chlorine, fluorine, bromine and iodine; carboxy; trifluoromethyl; cyano; nitro; sulfo groups having the formula $—SO_2R^4$; aminosulfonyl having the formula $—SO_2NHR^5$; aminocarbonyl having the formula $—CONHR^5$; and acyl having the formula $—COR^6$, where $R^4$ is fluorine, alkyl having from 1 to about 4 carbon atoms or phenyl; $R^5$ is hydrogen, alkyl having from 1 to about 4 carbon atoms or phenyl; and $R^6$ is alkyl having from 1 to about 6 carbon atoms or phenyl.

X in the above formula represents an anion. Typical anions include a halide ion, nitrate, phosphate, chlorate, or an anion derived from an organic acid such as formate, acetate or p-toluene sulfonate (PTS). A preferred anion is chloride.

Mercury salts which can be used in this invention include organic or inorganic salts, for example, mercurous or mercuric acetate; mercurous formate; mercurous or mercuric oxalate; mercurous or mercuric halides such as the chlorides, bromides, fluorides and iodides, including mixed halides such as mercuric bromoiodide or bromochloride; mercurous or mercuric nitrate and mercurous or mercuric sulfate. Due to solubility considerations, the mercury salts of acetic acid and the hydrohalogen acids are preferred.

The mercury salts, including the oxides, can be incorporated into a silver halide emulsion during preparation thereof or can be added to the emulsion immediately prior to coating of the emulsion onto a support. A mercury salt can also be incorporated into a hydrophilic colloid layer adjacent a silver halide emulsion layer.

As can be understood from the foregoing explanation, the oxide or the organic or inorganic salt of mercury, which can be used in this invention, can be either the mercurous or the mercuric compound. Where an oxide compound is employed, the preference is for mercuric oxide since this compound has greater solubility and appears to provide improved results as compared with mercurous oxide.

Typical examples of benzothiazolium compounds which can be used in combination with mercury salts in accordance with this invention include the following:

1.

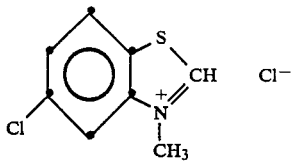

2.

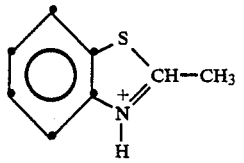

3.

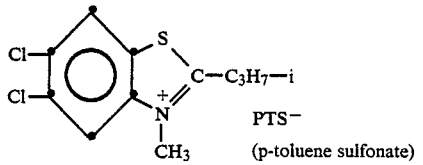

4.

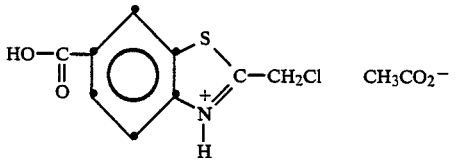

5.

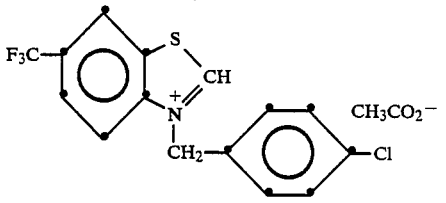

6.

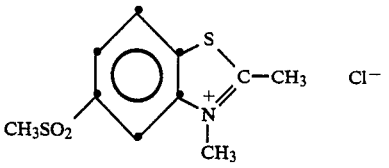

The amount of benzothiazolium compound which are usefully employed in this invention is from about 0.01 mmole to about 0.75 mmole thereof/mole of silver. Where less than about 0.01 mmole is employed the antifoggant activity is too low to be effective. In contrast, when amounts above about 0.75 mmole of benzothiazolium compound are used/mole of silver, there is a noticeable loss of photographic sensitivity. A preferred range of benzothiazolium compound is between about 0.1 mmole to about 0.5 mmole thereof/mole of silver.

Mixtures of two or more benzothiazolium compounds or two or more mercury compounds can be used to obtain the advantages of this invention.

The amount of mercury compound, when used in accordance with this invention, is usefully employed in an amount of from about 0.005 mmole to about 0.1 mmole thereof/mole of silver. A preferred amount of mercury compound is from about 0.05 mmole to about 0.1 mmole thereof/mole silver.

The amount of mercury compound which is used is related to the amount of benzothiazolium compound as well as to the silver concentration. For example, it has been found that higher concentrations of mercury compound can be used when a benzothiazolium compound is also present without experiencing undesirable loss of photographic speed and while still attaining high levels of fog inhibition. Whereas when used alone as little as 0.005 mmole of mercury compound/mole silver can cause objectionable speed loss, when a benzothiazolium compound, as described herein, is also present the mercury compound can be used in amounts up to about 0.1 mmole/silver mole while still attaining highly effective fog reduction without concommitant loss of photographic speed.

The practice of this invention is possible in black and white or in color photographic recording materials. In one embodiment, the recording material of this invention is a color photographic material which comprises a support having thereon a silver halide emulsion layer which has associated therewith a dye image-forming coupler compound. A coupler compound is preferably incorporated in a silver halide emulsion layer. However, it can be incorporated in another layer, such as a layer adjacent a silver halide layer, where it will come into reactive association with oxidized color-developing agent. Additionally, a silver halide emulsion layer and an adjacent layer containing the coupler compound can contain addenda conventionally contained in such layers.

Suitable color compounds include those which form cyan dyes upon reaction with oxidized color developing agents which are described in such representative patents and publications as U.S. Pat. Nos. 2,474,293; 2,772,162; 2,801,171; 2,895,826; 3,002,836; 3,419,390; 3,476,563; 3,779,763; 3,996,253; 4,124,396; 4,248,962; 4,254,212; 4,296,200; 4,333,999; 4,443,536; 4,457,559; 4,500,635 and 4,526,864, the disclosures of which are incorporated herein by reference.

Preferred cyan coupler structures are phenols and naphthols which form cyan dyes on reaction with oxidized color developing agent. These preferred structures include the following moieties:

C-1

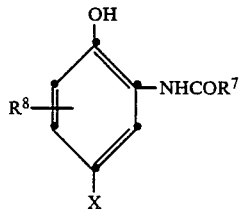

C-2

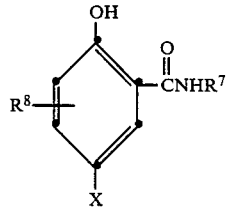

-continued

C-3

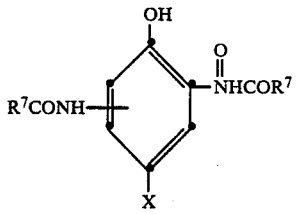

C-4

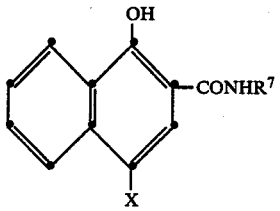

where $R^7$ represents a ballast group, especially a phenyl substituted ureido group as described in U.S. Pat. No. 4,333,999, $R^8$ represents one or more halogen atoms (e.g., chloro, fluoro), lower alkyl (e.g., methyl, ethyl, butyl) or lower alkoxy (e.g., methoxy, ethoxy, butoxy) groups and X is hydrogen or a coupling off group.

Magenta dye image-forming couplers which form magenta dyes upon reaction with oxidized color developing agents are described in such representative patents and publications as: U.S. Pat. Nos. 1,969,479; 2,311,082; 2,343,703; 2,369,489; 2,600,788; 2,908,573; 3,061,432; 3,062,653; 3,152,896; 8,519,429; 3,725,067; 4,120,723; 4,500,630; 4,540,654 and 4,581,326; and European Patent Publication Nos. 170,164 and 177,765; and copending U.S. application Ser. Nos. 23,517 of S. Normandin et al; 23,518 of R. Romanet et al; 23,519 of A. Bowne et al and 23,520 of A. Bowne et al, all filed Mar. 9, 1987, the disclosures of which are incorporated herein by reference.

Preferred magenta couplers include pyrazolone compounds having the structural formulae:

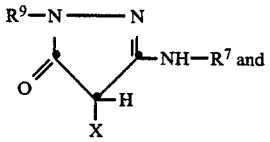

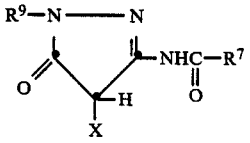

pyrazolotriazole compounds having the structural formulae:

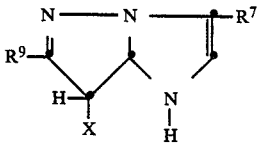

and

-continued

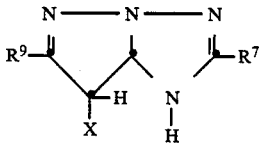

pyrazolobenzimidazole compounds having the structural formulae:

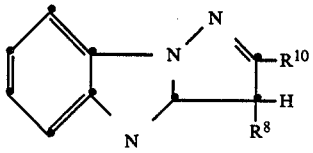

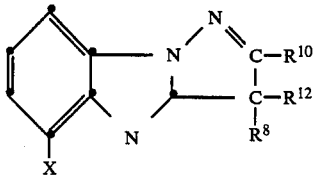

and indazole compounds having the structural formula:

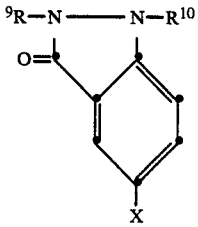

wherein

X is as defined above;

$R^7$ is a ballast group;

$R^9$ is halogen (e.g., chloro, fluoro), alkyl or alkoxy having from 1 to 4 carbon atoms, phenyl or substituted phenyl (e.g., 2,4,6-trihalophenyl);

$R^{10}$ is hydrogen or a monovalent organic radical, for example a saturated or unsaturated alkyl group having from 1 to about 20 carbon atoms (methyl, ethyl, propyl, butyl, decyl, dodecyl, heptadecyl, octadecyl); a cycloalkyl group (e.g., cyclohexyl; an aralkyl group (e.g. benzyl); an aryl group (e.g. phenyl, alkoxyphenyl) in which the alkyl or alkoxy radical has from 1 to about 20 carbon atoms, nitrophenyl, aminophenyl, acylaminophenyl, alkylaminophenyl, naphthyl, diphenyl, diphenylether, diphenylthioether); a heterocyclic group (e.g. α-furyl, α-benzofuryl, α-pyridyl); an amino, hydroxy or carboxylic acid group, it being possible for the hydrogen atoms of these groups to be substituted, for instance by a mono- or dialkylamino group in which the alkyl groups have from 1 to about 20 carbon atoms; a cycloalkylamino group; an amino group in which one hydrogen atom is replaced by a pyrazolo-[1,5-α]-benzimidazolyl radical which is bonded in 3- position to said nitrogen atom so that couplers result in which two pyrazolo-[1,5-α]-benzimidazolyl radicals are connected by an amino group, and in which the remaining hydrogen atom may be replaced by a substituent such as an alkyl-, aryl-, aralkyl- or acyl- radical; an acylamino group in which the acyl radical is derived from an aliphatic, aromatic or heterocyclic carboxylic acid; a carboxylic acid group which is esterified by means of an aliphatic, cycloaliphatic or aromatic alcohol or by an aromatic compound having an phenolic hydroxy group; or a carboxyamido group in which the amido group may be substituted for example by a saturated or unsaturated alkyl, aralkyl, aryl or heterocyclic group;

$R^{11}$ represents a hydrogen atom, a sulphonic acid or a carboxylic acid group; a halogen atom (e.g. chlorine or bromine); or an azo radical —N=$NR^{16}$, wherein $R^{16}$ can be an aromatic or heterocyclic radical (phenyl, naphthyl, diphenyl, diphenylether, benzthiazolyl, pyridyl, quinolyl or pyrazolyl) which may be substituted such as by an alkyl group having from 1 to about 20 carbon atoms, hydroxy, alkoxy, halogen, amino, substituted amino, nitro, sulphonic acid or carboxylic acid groups;

$R^{12}$ represents a divalent radical such as

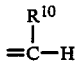

where $R^{13}$ can be alkyl, aralkyl, especially phenyl, phenyl substituted preferably in the p-position by a tertiary amino group such as a dialkylamino group in which at least one of the alkyl groups is substituted by carboxy, sulpho, hydroxy, alkoxy, carboxylalkyl, cyano or the divalent radical

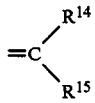

wherein $R^{14}$ and $R^{15}$ represent aliphatic, aromatic, araliphatic or heterocyclic radicals.

Couplers which form yellow dyes upon reaction with oxidized color developing agent are described in such representative U.S. Pat. Nos. 2,298,443; 2,875,057; 2,407,210; 3,265,506; 3,384,647; 3,408,194; 3,415,652; 3,447,928; 3,542,840; 4,046,575; 3,894,875; 4,095,983; 4,182,630; 4,203,768; 4,221,860; 4,326,024; 4,401,752; 4,443,536; 4,529,691; 4,587,205; 4,587,207 and 4,671,256 the disclosures of which are incorporated herein by reference.

Preferred yellow dye image-forming couplers are cylacetamides, such as benzoylacetanilides and pivalylacetanilides. Structures of such preferred coupler moieties are:

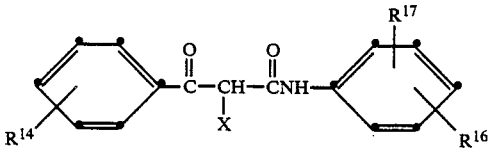

Y-1

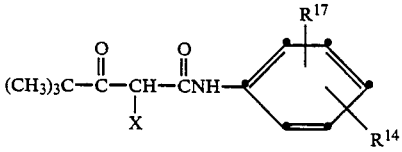

Y-2 where $R^{14}$ and $R^{16}$ are as defined above, $R^{17}$ is hydrogen or one or more halogen, lower alkyl (e.g. methyl, ethyl) or a ballast (e.g. alkoxy of 16 to 20 carbon atoms) group and X is a coupling off group.

In the following discussion of suitable materials for use in the recording materials of this invention, reference will be made to *Research Disclosure,* Dec. 1978, Item 17643, published by Industrial Opportunities Ltd., Homewell Havant, Hampshire, PO9 1EF, U.K., the disclosures of which are incorporated herein by reference. This publication will be identified hereafter by the term "*Research Disclosure*".

The silver halide emulsions employed in the elements of this invention can be either negative-working or positive-working. Suitable emulsions and their preparation are described in *Research Disclosure* Section I and II, and the publications cited therein, and can include coarse, medium or fine grains or mixtures thereof. The grains may be of different morphologies, e.g., spherical, cubic, cubooctrahedral, tabular, etc., or mixtures thereto. Grain size distribution may be monodisperse or polydisperse or mixtures thereof.

Such silver halides includes silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized as described in Research Disclosure Sections III and IV.

The emulsions preferably contain gelatin, although other natural or synthetic vehicles, including hydrophilic colloids. soluble polymers or mixtures thereof can be used. Suitable vehicles for the emulsion layers and other layers of elements of this invention are described in Research Disclosure Section IX and the publications cited therein.

The imaging elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI), matting agents (Research Disclosure Section XVI) and development modifiers (Research Disclosure Section XXI).

The imaging elements can be coated on a variety of supports as described in Research Disclosure Section XVII and the reference described therein.

The silver halide emulsions as well as other layers of the photographic recording materials of this invention can contain as vehicles hydrophilic colloids, employed alone or in combination with other polymeric materials (e.g., latices). Suitable hydrophilic materials include both naturally occurring substances such as proteins, protein derivatives, cellulose derivatives - e.g., cellulose esters, gelatin - e.g., alkali treated gelatin (cattle, bone, or hide gelatin) or acid treated gelatin (pigskin gelatin), gelatin derivatives - e.g., acetylated gelatin, phthalated gelatin, and the like, polysaccharides such as dextran, gum arabic, zein, caein, pectin, collagien derivatives, collodion, agar-agar, arrowroot, and albumin. The vehicles can be hardened by conventional procedures. Further details of the vehicles and hardeners are provided in *Research Disclosure,* Item 17643, noted above, Section IX and X.

The following is presented to further illustrate this invention. Unless otherwise indicated all parts, percents and ratios are by weight.

EXAMPLE 1

On a polyethylene coated paper support was coated a chemically sensitized surface latent image forming cubic grain silver chloride emulsion, of mean grain size 0.67μm, at 0.34 g/m$^2$ Ag, 1.08 g/m$^2$ yellow dye forming coupler(1) and 1.66 g/m$^2$ gelatin. The coating was hardened with bis(vinylsulfonylmethyl) ether (BVSME) at 1.79% of the gelatin weight. Additions of fog-inhibiting agents were made as listed in Table I, the benzothiazolium salt was Compound No. 1, as identified above. Fresh samples of the coated paper were exposed for 1/10 second through a graduated density tablet to a 3000° K. tungsten light source in an EASTMAN 1B Sensitometer, and then processed at 35° C. in a three-step process consisting of a 45-second development step, a 45-second bleach-fix step, and a 90-second stabilizing step, followed by a one-minute drying step at a temperature of 60° C.

The color developing, bleach-fixing and stabilizing compositions used in the process were as follows:

Color Developing Composition

| | |
|---|---|
| Lithium salt of sulfonated polystyrene | 0.25 ml |
| Triethanolamine | 11.0 ml |
| N,N—diethylhydroxylamine | 6.0 ml |
| Potassium sulfite | 0.5 ml |
| Color developing agent* | 5.0 g |
| Stain reducing agent** | 2.3 g |
| Potassium chloride | 2.3 g |
| EDTA (2NA.$H_2O$) | 3.0 g |
| 3,4-dihydroxy-1,2,5-benzenetrisulfonic acid trisodium salt | 0.6 g |
| Potassium carbonate | 25.0 g |

-continued

| Color Developing Composition | |
|---|---|
| Water to total of 1 liter | (pH 10.04) |

*4-(N—ethyl-N—2-methanesulfonylaminoethyl)-2-methylphenylenediaminesequisulfate monohydrate.

**A stilbene compound available under the trademark KODAK EKTAPRINT 2 Stain-Reducing Agent from Eastman Kodak Company.

Bleach-Fixing Composition

The bleach-fixing composition had a pH of 6.2 and was comprised of ammonium thiosulfate, sodium bisulfite, and an ammonium salt of the ferric complex of ethylenediaminetetraacetic acid.

Stabilizing Composition

The stabilizing composition had a pH of 7.2 and was comprised of formaldehyde, sodium metabisulfite, potassium hydroxide, diethylene glycol, 5-chloro-2-methyl-4-isothiazolin-3-one, the disodium salt of ethylenediamine-tetraacetic acid, and 1-hydroxyethylidene-1,1-diphosphonic acid.

Results from these fresh samples are shown in Table I. Fresh unprocessed samples were incubated for 8 weeks at 49° C. and 50% relative humidity (RH) and then similarly exposed and processed.

Results from these incubated samples are also reported in Table I.

(1) Yellow Dye Forming Coupler:

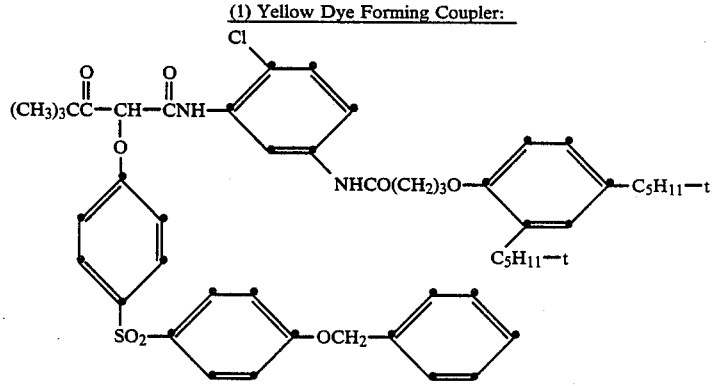

TABLE I

| Coating No. | Benziothiazolium Salt (mmole Ag) | Mecuric Acetate (mmole Ag) | Relative Speed | Fresh Dmin | After 8 wks. @ 49° C./30% RH Speed | After 8 wks. @ 49° C./30% RH Dmin |
|---|---|---|---|---|---|---|
| 1 | 0 | 0 | 153 | .135 | —(a) | 1.94 |
| 2 | 0 | 0.041 | 98 | .111 | —(a) | 1.99 |
| 3 | 0.078 | 0.041 | 102 | .071 | 98 | 0.51 |
| 4 | 0.078 | 0.072 | 82 | .074 | 82 | 0.28 |
| 5 | 0.546 | 0.0094 | 157 | .069 | 189 | 0.38 |
| 6 | 0.546 | 0.072 | 144 | .066 | 140 | 0.09 |

(a)Speed unmeasureable due to high fog.

From Table I it can be seen that as the amount of benzothiazolium salt increases the fog level decreases and that relatively high mercury concentrations can be employed without seriously affecting photographic speed when the benzothiazolium salt is used in high concentration.

Example 2

Coatings similar to those described in Example 1 were prepared with a cubic silver chlorobromide emulsion (15 mole % chloride), of mean grain size 0.75μm, at 0.28 g/m² Ag, 0.99 g/m² of the yellow dye forming coupler as described in Example 1 and 1.66 g/m² gelatin. The coating was similarly hardened with BVSME at 1.75% of the gelatin weight. Additions of fog-inhibiting agents were made as listed in Table II. Samples of the coated paper were exposed as in Example 1, and then processed 1.5 minutes at 33° C. employing the color developer identified below, then 1.5 minutes in the bleach-fix bath, washed and dried.

| | |
|---|---|
| Color Developer (pH 10.08) | |
| Triethanolamine | 11 ml |
| Benzyl alcohol | 14.2 ml |
| Lithium chloride | 2.1 g |
| Potassium bromide | 0.6 g |
| Hydroxylamine sulfate | 3.2 g |
| Potassium sulfite (45% solution) | 2.8 ml |
| 1-Hydroxyethylene-1,1-di phosphoric acid (60%) | 0.8 ml |
| 4-Amino-3-methyl-N—ethyl-N—B-methanesulfonamido)ethyl-aniline sulfate hydrate | 4.35 g |
| Potassium carbonate (anhydrous) | 28 g |
| Stilbene whitening agent | 0.6 g |
| Surfactant | 1 ml |
| Water to make | 1.0 liter |
| Bleach-Fix Bath (pH 6.8) | |
| Ammonium thiosulfate | 104 g |
| Sodium hydrogen sulfite | 13 g |
| Ferric ammonium ethylene-diamine tetraacetic acid (EDTA) | 65.6 g |
| Ammonium hydroxide (28%) | 27.9 ml |
| Water to make | 1 liter |

TABLE II

| Coating No. | Benzothiazolium Salt mmole/mole Ag | Mercuric Acetate mmole/mole Ag | Relative Speed | Fresh Dmin | After 18 months at 24° C. Speed | After 18 months at 24° C. Dmin |
|---|---|---|---|---|---|---|
| 7 | 0 | 0 | 191 | .08 | 197 | .42 |
| 8 | 0 | 0.062 | 124 | .05 | 106 | .08 |
| 9 | 0.63 | 0 | 161 | .07 | 179 | .19 |
| 10 | 0.63 | 0.062 | 153 | .06 | 160 | .09 |

From Table II it can be seen that a combination of a benzothiazolium salt and a mercury compound provide both fog reduction and acceptable photographic speed results as compared with results obtainable using either of the compounds alone.

This invention has been described in detail with particular reference to preferred embodiments thereof, but it will be understood that variations and modifications can be effected within the spirit and scope of the invention.

I claim:

1. A photographic recording material comprising a support having thereon a radiation sensitive silver halide emulsion layer and an effective amount of a fog inhibiting combination of (a) a compound which is an oxide or a salt of mercury, and (b) a benzothiazolium compound having the structural formula:

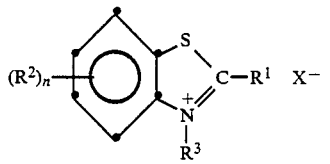

wherein:

$R^1$ is hydrogen or an alkyl group having from 1 to about 4 carbon atoms;

$R^2$ is an electron withdrawing group;

$R^3$ is hydrogen, an alkyl group having from 1 to about 4 carbon atoms or benzyl;

X is an anion;

n is 0 or from 1 to 3; wherein at least one of $R^1$ and $R^3$ is substitute d with a halogen atom, hydroxy, mercapto or alkoxy comprising from 1 to about 4 carbon atoms.

2. A photographic recording material according to claim 1 wherein the halogen atom is chlorine.

3. A photographic recording material according to claim 1 wherein $R^2$ is a halogen atom; carboxy; trifluoromethyl; cyano; nitro; sulfo; aminosulfonyl; aminocarbonyl or acyl group.

4. A photographic recording material according to claim 3 wherein $R^2$ is chlorine, fluorine, bromine or iodine.

5. A photographic recording material according to claim 3 wherein $R^2$ is sulfo having the formula $—SO_2R^4$ wherein $R^4$ is fluorine, alkyl of from 1to 4 carbon atoms or phenyl.

6. A photographic recording material according to claim 1 wherein X is halide, nitrate, phosphate, chlorate, formate, acetate or p-toluene sulfonate.

7. A photographic recording material according to claim 6 where X is chloride.

8. A recording material according to claim 1 wherein the mercury salt is mercuric acetic.

9. A photographic recording material according to claim 1 wherein the mercury compound is mercuric oxide.

10. A photographic recording material according to claim 1 wherein the mercury compound is present in an amount of from about 0.005 mmole to about 0.1 mmole/mole of silver.

11. A photographic recording material according to claim 11 wherein the mercury compound is present in an amount of from about 0.05 mmole to about 0.1 mmole/mole of silver.

12. A photographic recording material according to claim 1 wherein the benzothiazolium compound is present in an amount of from about 0.01 mmole to about 0.75 mmole/mole of silver.

13. A photographic recording material according to claim 12 wherein the benzothiazolium compound is present in an amount of from about 0.1 mmole to about 0.5 mmole/mole of silver.

* * * * *